US006618879B1

(12) United States Patent
Wu

(10) Patent No.: US 6,618,879 B1
(45) Date of Patent: Sep. 16, 2003

(54) PORTABLE BED FRAME

(76) Inventor: Chung-Sen Wu, Floor 3, No. 8, Lane 295, Section 1, Fu Hsing South Road, Taipei (TW)

( * ) Notice: Subject to any disclaimer, the term of this patent is extended or adjusted under 35 U.S.C. 154(b) by 0 days.

(21) Appl. No.: 10/219,311

(22) Filed: Aug. 16, 2002

(51) Int. Cl.[7] ..... A47C 17/64
(52) U.S. Cl. ..... 5/111; 5/116; 5/110
(58) Field of Search ..... 5/110, 111, 114, 5/116, 117

(56) References Cited

U.S. PATENT DOCUMENTS 1,276,539 A * 8/1918 Juten ..... 5/112
1,360,201 A * 11/1920 Dyett ..... 5/117
1,557,813 A * 10/1925 Derse et al. ..... 108/175
1,608,924 A * 11/1926 Brown ..... 108/118
1,693,537 A * 11/1928 Adkins et al. ..... 5/114
1,787,566 A * 1/1931 Brown ..... 5/117
2,591,551 A * 4/1952 Kaplan ..... 5/110
5,555,576 A * 9/1996 Kim ..... 5/114

* cited by examiner

*Primary Examiner*—Michael F. Trettel
(74) *Attorney, Agent, or Firm*—Rosenberg, Klein & Lee

(57) ABSTRACT

A portable bed includes a main part and support members. The main part consists of two pairs of parallel rods for supporting a cloth. The support members are connected to the main part and provide support therefore. The support members each have pivotally connected leg elements so that they can be moved to cross-legged, in use position to support the main part. The support members are each provided with strengthening elements to stand more stably. The strengthening elements each include a strengthening rod, a limiting member, and a slide. One end of the strengthening rod is pivoted to a corresponding limiting member, which is affixed to a corresponding leg element. An opposing end of the strengthening rod is pivoted to a corresponding slide capable of sliding along the other leg element.

2 Claims, 8 Drawing Sheets

PORTABLE BED FRAME

BACKGROUND OF THE INVENTION

1. Field of the Invention

The present invention relates to a portable bed frame, and more particularly to a portable bed frame, which has pivotally connected legs provided with strengthening elements so that it can be supported in a laid-out position more stably.

2. Brief Description of the Prior Art

Referring to FIGS. 1, and 2, a conventional portable bed includes a main part, several support members 10, and a cloth 30. The main part consists of two elongated rods 20 arranged parallel to each other, and two transverse rods 40. The elongated rods 20 each have extension portions 201 at opposing ends. The transverse rods 40 are detachably connected to the extension portions 201. Connecting elements are fitted to the ends, and the middle of each of the elongated rods 20. The cloth 30 is tough, and is joined to the elongated rods 20, and the transverse rods 40, at edges thereof, with gaps being formed near the connecting elements.

Each of the support members 10 includes a first supporting leg 101, two second supporting legs 102, and two joining members 50. The joining members 50 each have two connecting portions extending from the center thereof in opposite directions. The joining members 50 are pivoted to two opposing sides of a central portion the first supporting leg 101. The second supporting legs 102 are fixedly connected to the connecting portions of the joining members 50. Thus, each the of second legs 102 of the pair of second legs are directed in opposite directions. The upper end of the first leg 101, and the upper end of the upper one of the second legs 102 of each support member 10 are connected to the connecting elements fitted to the elongated rods 20.

To use the portable bed, the elongated rods 20 are moved away from each other, the joining members 50 pivoting on the corresponding first legs 101 to a position crossing the second legs 102. The transverse rods 40 are joined to the extension portions 201 to support two ends of the cloth 30. Thus, the bed can be supported in the laid-out position by the support members 10.

To fold the bed, referring to FIG. 4, the transverse rods 40 are detached from the extension portions 201, and the elongated rods 20 are moved close to each other, the joining members 50 pivoting on the corresponding first legs 101. Consequently, the second legs 102, and the first legs 101 are positioned side by side.

The bed can be easily unfolded for use, and folded to be transported. However, it has a disadvantage in that it is not very stable because the support members 10 lack strengthening elements to hold them stably in the laid-out position.

SUMMARY

It is the main object of the present invention to provide strengthening elements to support legs of a portable bed so that the bed can stand more stably when it is laid-out for use.

The portable bed includes a main part and support members. The main part consists of two pairs of parallel rods. The support members are connected to the main part. The support members each have leg elements pivotally connected thereto, so that it can be moved to an outwardly extended cross-legged position to support the main part. The support members are each provided with strengthening elements to stand more stably. One of the strengthening elements includes a strengthening rod, a limiting member, and a slide. A lower end of the strengthening rod is pivoted to a corresponding limiting member, which is affixed to a corresponding leg element. An upper end of the strengthening rod is pivoted to a corresponding slide, which can slide along the other leg element.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 1:
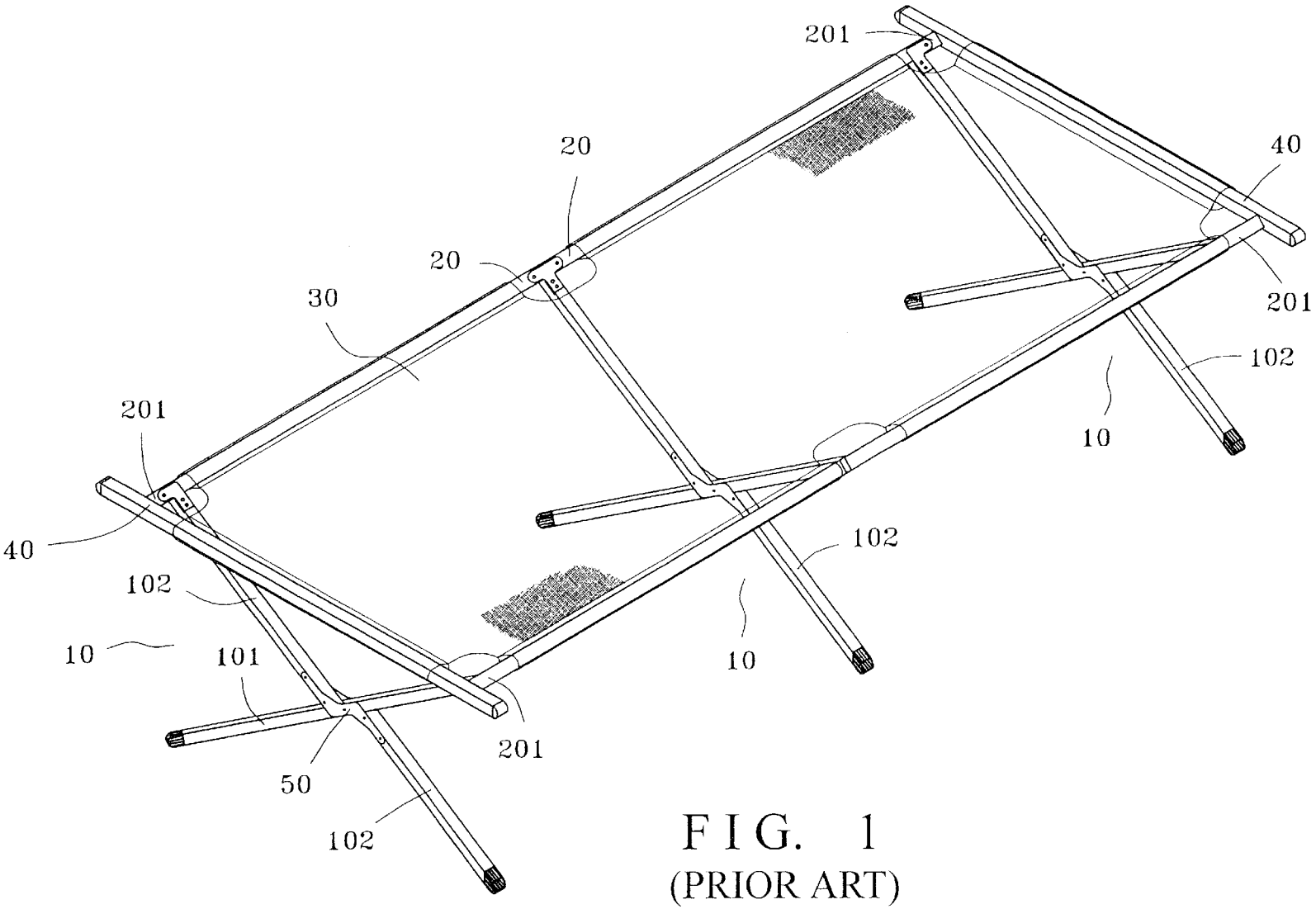
FIG. 1 (PRIOR ART)
FIG. 1 is a perspective view of the conventional portable bed as described in the Background.
Figure 4:
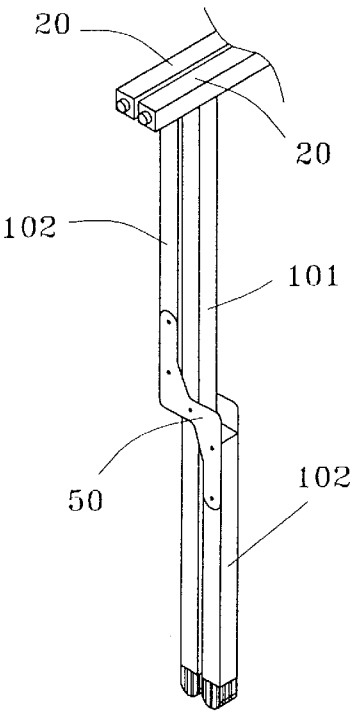
FIG. 4 (PRIOR ART)
FIG. 4 is a partial view of the conventional portable bed in the folded position.
Figure 2:
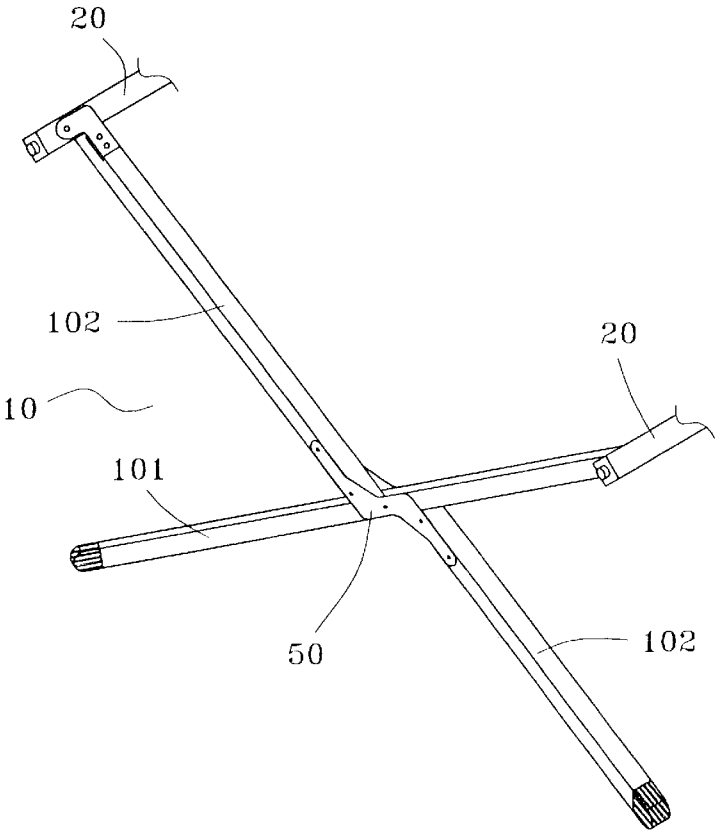
FIG. 2 (PRIOR ART)
FIG. 2 is a partial perspective view of the conventional portable bed.
Figure 3:
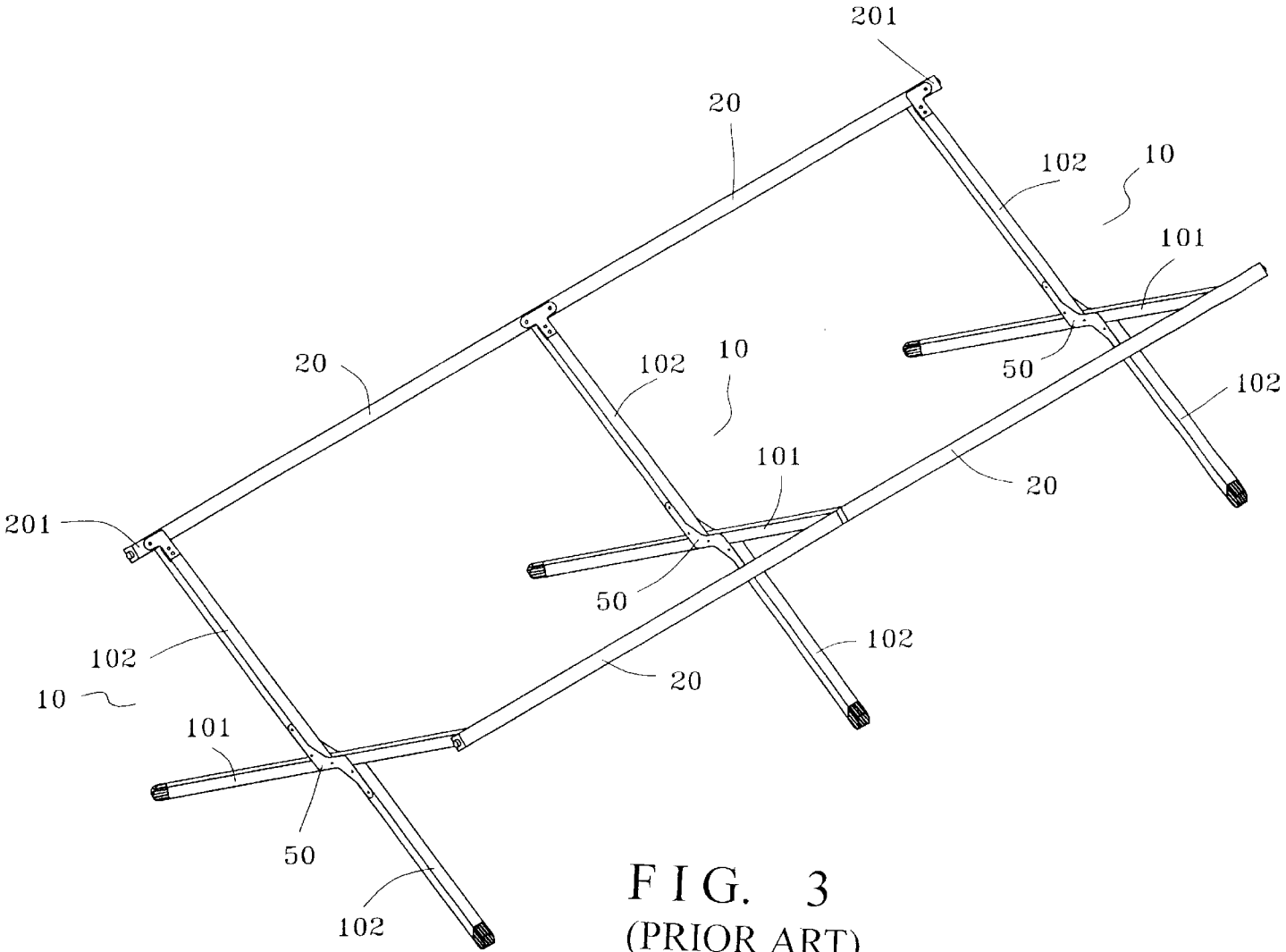
FIG. 3 (PRIOR ART)
FIG. 3 is a perspective view of the conventional portable bed.
Figure 5:
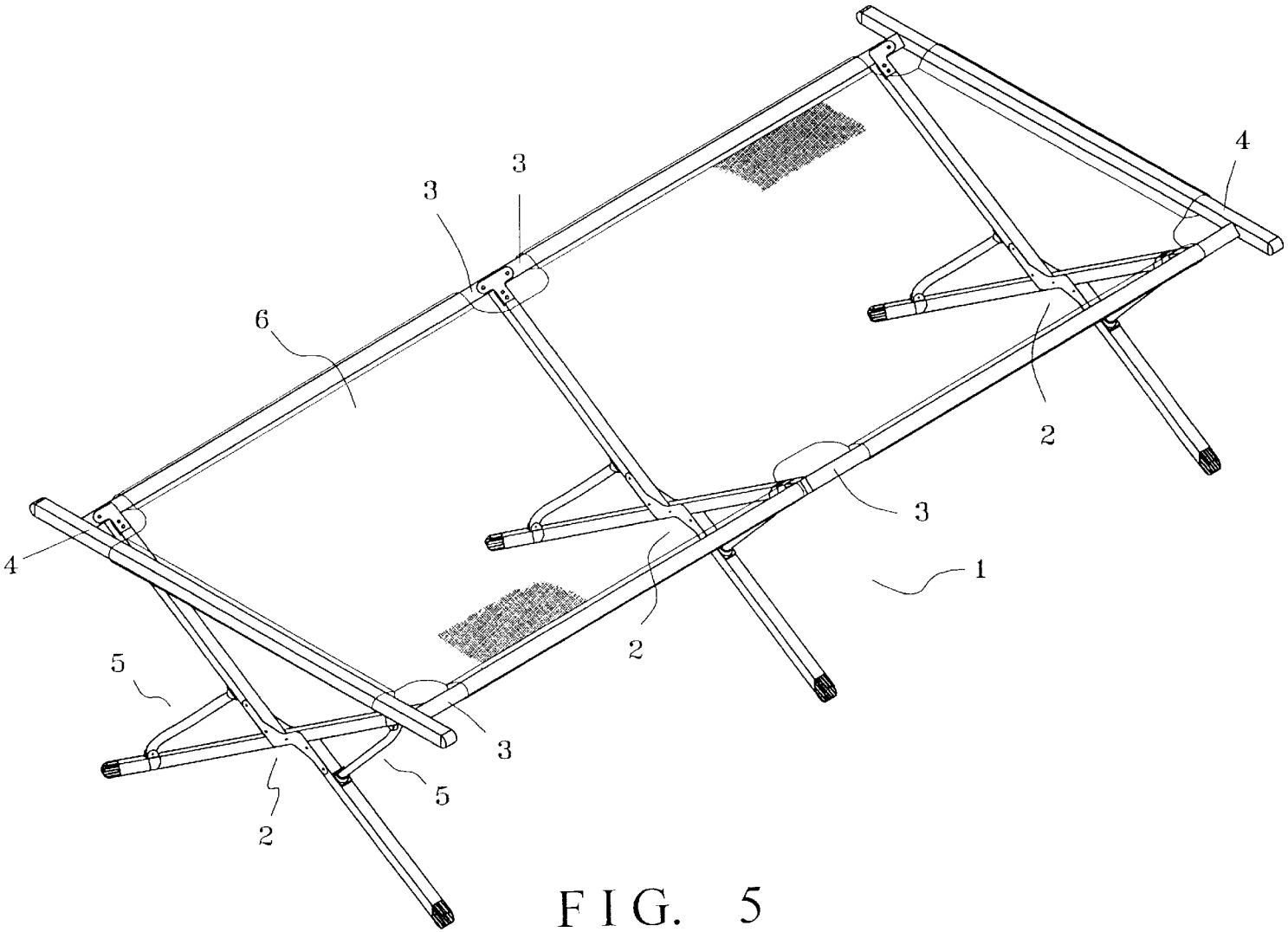
FIG. 5 is a perspective view of a portable bed of the present invention.
Figure 6:
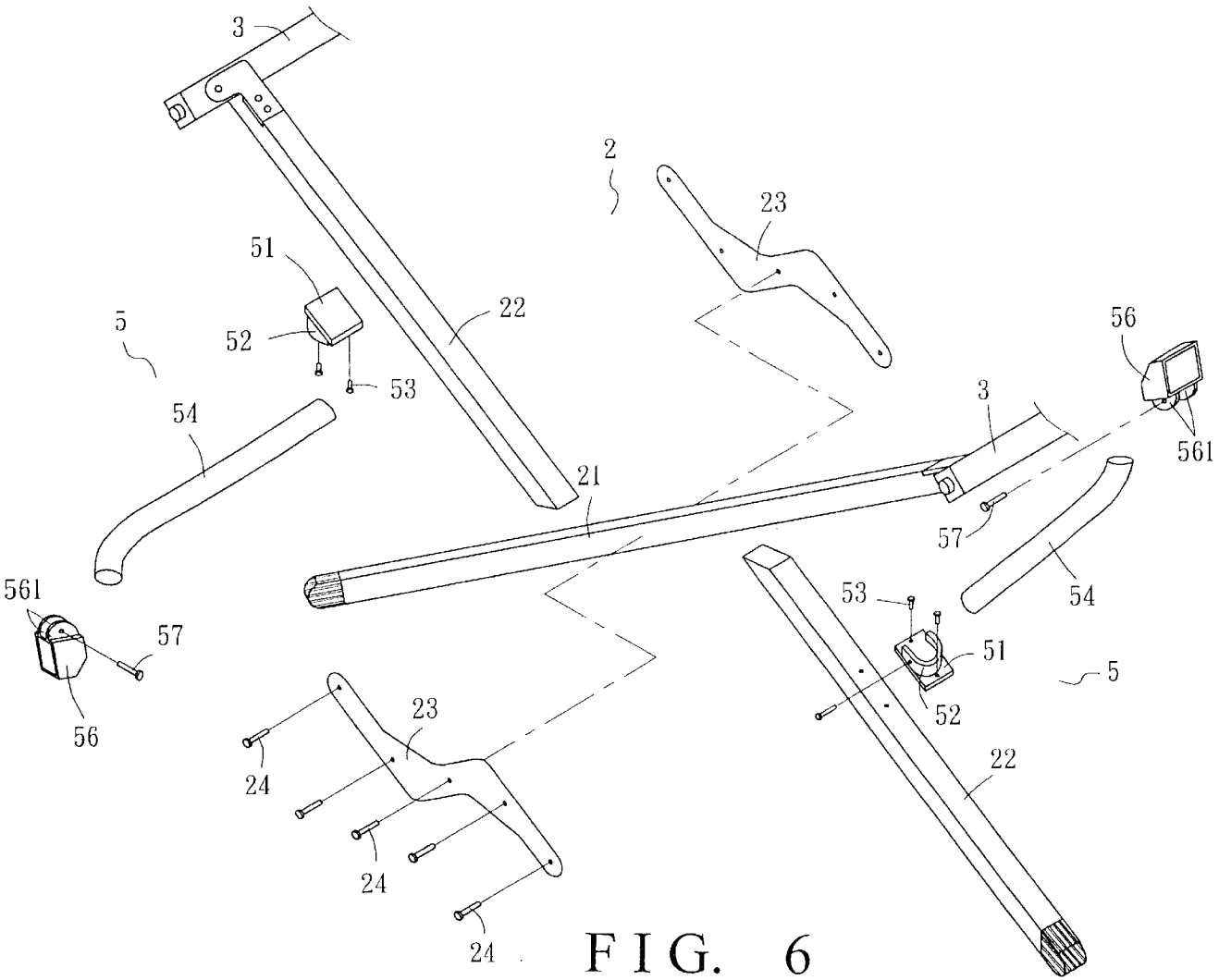
FIG. 6 is a fragmentary exploded perspective view of the portable bed of the present invention.
Figure 7:
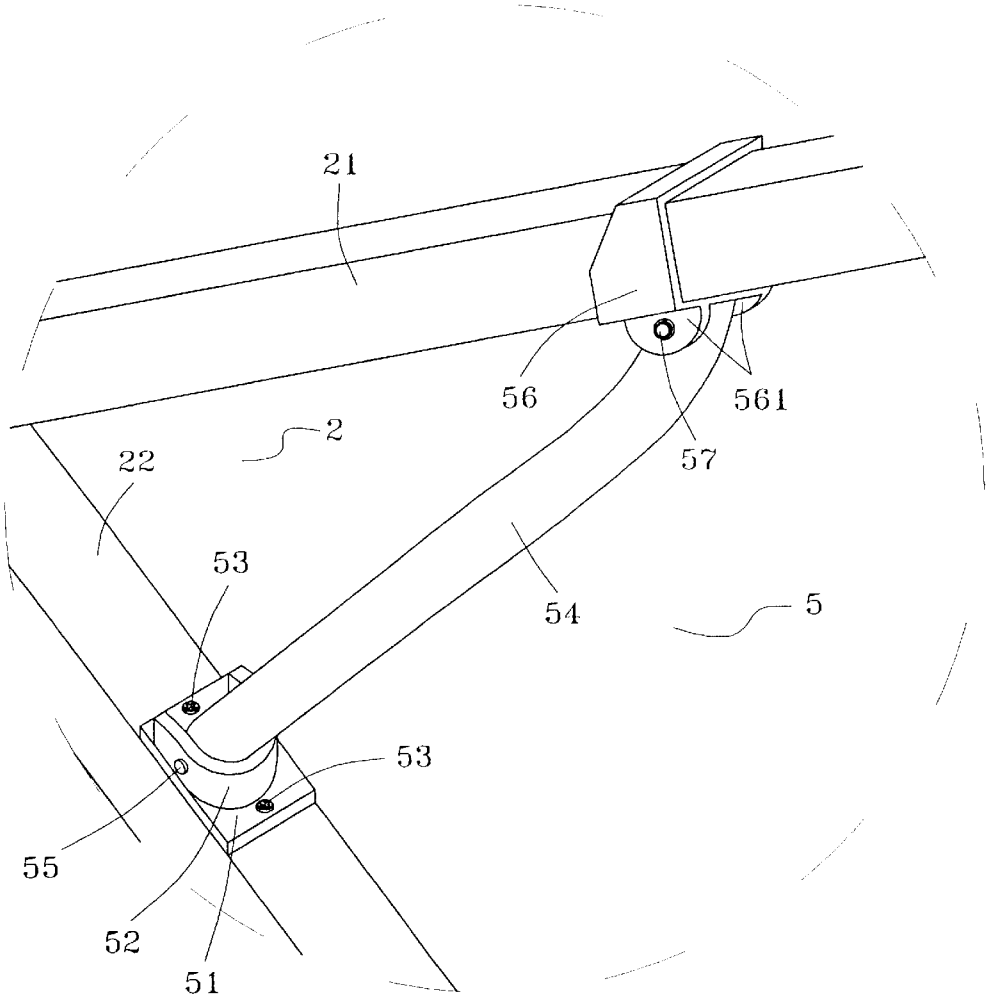
FIG. 7 is a view of a strengthening element for a bed support member of the present invention.
Figure 8:
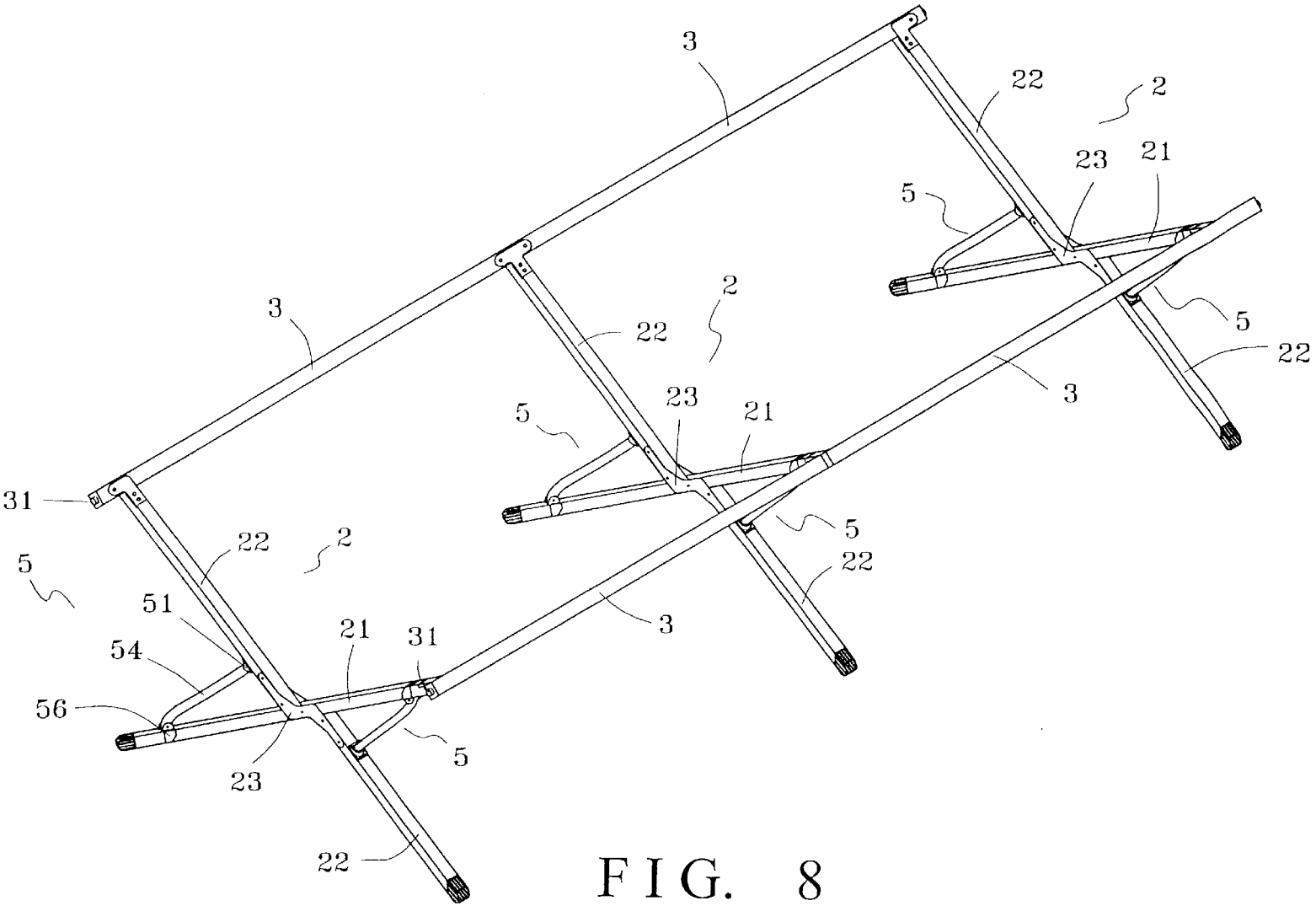
FIG. 8 is a perspective view of the portable bed of the present invention.
Figure 10:
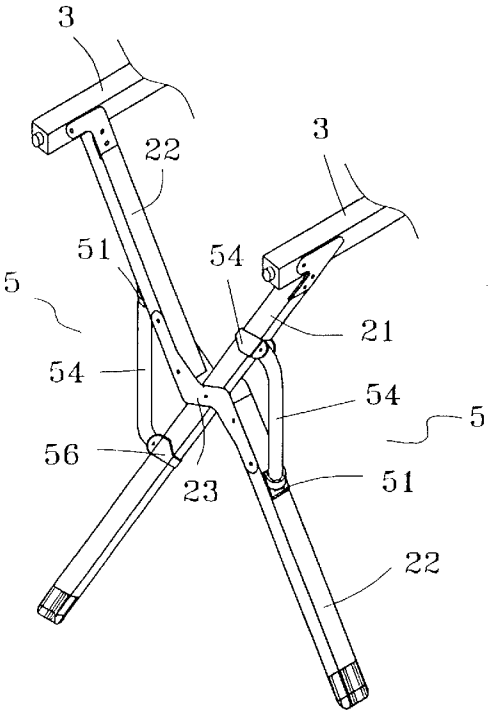
FIG. 10 is a partial view of the present portable bed of the present invention during a folding operation; and, FIG. 11 is a partial view of the portable bed of the present invention in the folded position.

Referring to FIGS. 5, 6, and 10, a portable bed of the present invention is shown to include a main part 1 and several support members 2.

The main part 1 consists of two parallel elongated rods 3, and two transverse rods 4 detachably connected to the elongated rods 3. The elongated rods 3 each have extension portions 31 (FIG. 9) at opposing ends. The transverse rods 4 are detachably connected to the extension portions 3l. Connecting elements are fitted to the ends and the middle of each of the clongated rods 3. A tough cloth 30 is joined to the elongated rods 3 and the transverse rods 4, at the edges thereof, with gaps being respectively formed near each of the connecting elements.

Each of the support members 2 includes a first supporting leg 21, two second supporting legs 22, and two joining members 23. The joining members 23 each have two connecting portions extending from a central portion in opposite directions. The central portions of a pair of joining members 23 are respectively pivoted to two opposing sides of a central portion of a respective supporting leg 21 with pins 24. The second legs 22 are fixedly connected to the connecting portions of the pair of joining members 23 by means of pins 24. Thus, second legs 22 of each pair thereof are directed in opposite directions. The upper end of the first leg 21, and upper end of the upper one of the second legs 22 of each support member 2 are connected to respective connecting elements fitted to the elongated rods 3.

Furthermore, each of the support members 2 is provided with a pair of strengthening elements 5 to fix the support member 2 in the outwardly extended cross-legged position. In each of the support members 2, one of the strengthening elements 5 includes a strengthening rod 54, a limiting member 51, and a slide 56. A lower end of the strengthening rod 54 is pivoted to a corresponding limiting member 51, which is affixed to a lower one of the second legs 22 by means of rivets 53. An upper end of the strengthening rod 54 is pivoted by a pivotal pin 57 to a corresponding slide 56, which is fitted around an upper section of a corresponding first leg 21 to slide along that first leg. In each of the support members 2, the other one of the strengthening elements 5 also includes a strengthening rod 54, a limiting member 51, and a slide 56. An upper end of the other strengthening rod 54 is pivoted to a corresponding limiting member 51, which is affixed to an upper one of the second legs 22 by means of rivets 53. A lower end of the other strengthening rod 54 is pivoted by a pivotal pin 57 to a corresponding slide 56, which is fitted around a lower section of a corresponding first leg 21 to be able to slide along that first leg. In addition, each of the limiting members 51 respectively affixed to the lower of the second legs 22 is formed with a U-shaped limiting protrusion 52 at a lower end thereof, and each of the limiting members 51 affixed to the upper of the second legs 22 is also formed with a U-shaped limiting protrusion 52 at an upper end thereof.

Figure 9:
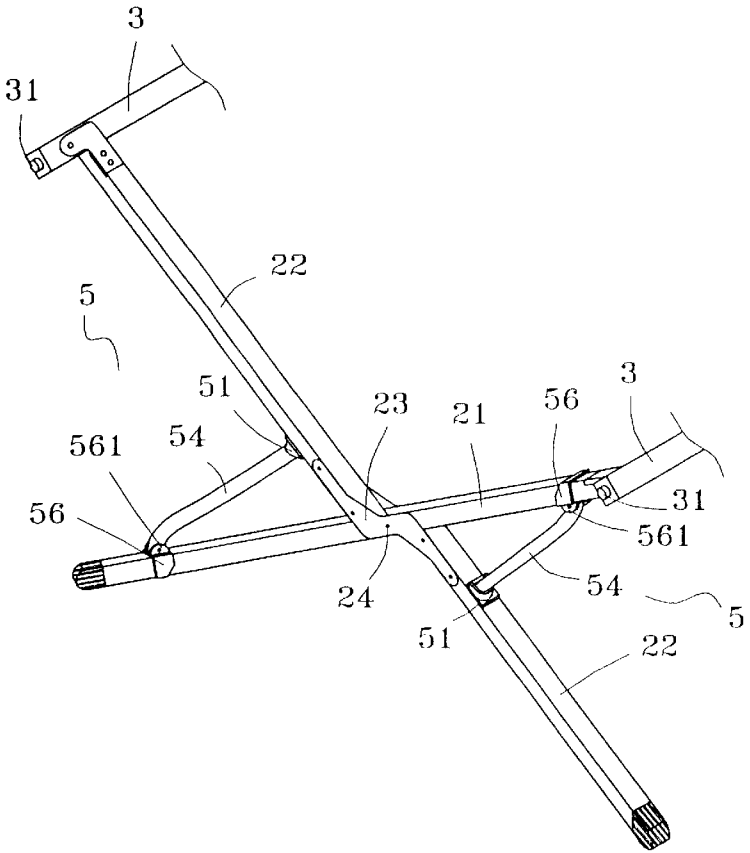
FIG. 9 is a partial perspective view of the portable bed of the present invention.

Thus, referring to FIG. 9, the strengthening elements 5 help the support members 2 stand stably in a cross-legged, in use position so that the portable bed is more stable. To fold the portable bed, referring to FIG. 10, the transverse rods 4 are detached from the extension portions 31, and the elongated rods 3 are moved close to each other, the joining members 23 pivoting on the corresponding first legs 21 and the slides 56 sliding on the first legs 21.

Figure 11:
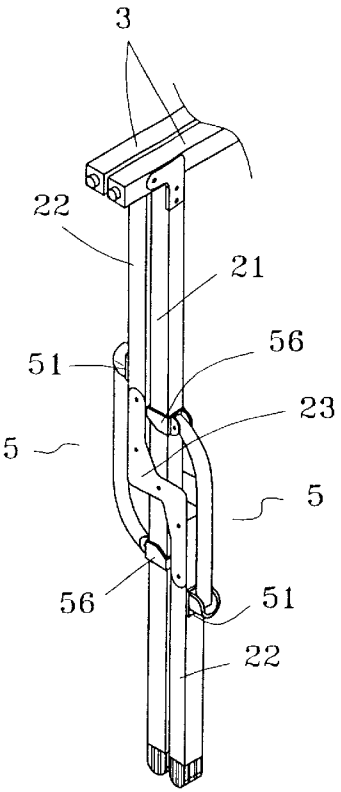

Movement of the strengthening elements is stopped by the U-shaped limiting protrusions 52 of the limiting members 51 when the bed frame is moved to the laid-out position. Referring to FIG. 11, the strengthening rods 54 of the strengthening elements 5 of each support member 2 can be positioned closely together when the bed frame is folded, not hindering the folding operation of the bed frame and the support members 2.

While the preferred embodiments of the invention have been described above, it will be recognized and understood that various modifications may be made therein, and the appended claims are intended to cover all such modifications which may fall within the spirit and scope of the invention.

What is claimed is:

1. A portable bed frame, comprising:

a main part consisting of two parallel elongated rods and two transverse rods respectively detachably connected to said elongated rods; and, a plurality of support members each being joined to two opposing portions of said elongated rods, each of said support members including a first leg, a pair of second legs, and a pair of joining members, said pair of second legs being joined to two opposite extension portions of said pair of joining members, each of said pair of joining members being pivoted to a middle portion of said first leg, each of said support members further including a first strengthening element and a second strengthening element to fix said support members in an outwardly extended cross-legged position, each of said first and second strengthening elements including a strengthening rod, a limiting member, and a slide, one end of said strengthening rod being pivoted to said limiting member affixed to one of said second legs, an opposing end of said strengthening rod being pivoted to said slide, said slide being adapted for sliding along a corresponding section of said first leg, said strengthening rods of said first and second strengthening elements being positioned closely together when the bed frame is folded.

2. The portable bed frame as claimed in claim 1, wherein a portion of said limiting members are affixed to a lower one of said second legs and are formed with a limiting protrusion at a lower end thereof, and a remaining portion of said limiting members are affixed to an upper one of said second legs and are formed with a limiting protrusion at an upper end thereof, thereby movement of each said strengthening rod is respectively stopped by a respective limiting protrusion when the bed frame is moved to a laid out position.

* * * * *